US007325538B2

(12) United States Patent
Bean

(10) Patent No.: US 7,325,538 B2
(45) Date of Patent: Feb. 5, 2008

(54) VERSATILE VORTEX AIR GENERATOR AND METHOD OF INSTALLATION

(76) Inventor: Darrell S Bean, 341 Hill Ave., Guntersville, AL (US) 35976

( * ) Notice: Subject to any disclaimer, the term of this patent is extended or adjusted under 35 U.S.C. 154(b) by 272 days.

(21) Appl. No.: 10/907,812

(22) Filed: Apr. 15, 2005

(65) Prior Publication Data

US 2006/0230844 A1 Oct. 19, 2006

(51) Int. Cl.
*F02M 29/06* (2006.01)

(52) U.S. Cl. ..... 123/590; 123/65 W; 123/306

(58) Field of Classification Search ..... 123/590, 123/65 W, 306
See application file for complete search history.

(56) References Cited

U.S. PATENT DOCUMENTS

| | | | | |
|---|---|---|---|---|
| 4,240,293 | A | 12/1980 | Hughes | |
| 4,318,386 | A | 3/1982 | Showalter | |
| 4,424,714 | A | 1/1984 | Johnson | |
| 4,976,248 | A | 12/1990 | Rowe | |
| 5,000,152 | A | 3/1991 | McCauley | |
| 5,113,838 | A * | 5/1992 | Kim | 123/592 |
| 5,685,281 | A * | 11/1997 | Li | 123/590 |
| 6,041,753 | A * | 3/2000 | Lin et al. | 123/306 |
| 6,158,412 | A * | 12/2000 | Kim | 123/306 |
| 6,260,530 | B1 | 7/2001 | Keon, Jr. | |
| 6,536,420 | B1 * | 3/2003 | Cheng | 123/590 |
| 6,796,296 | B2 * | 9/2004 | Kim | 123/590 |
| 6,932,049 | B2 * | 8/2005 | Kim | 123/306 |
| 7,055,512 | B2 * | 6/2006 | Leuenberger | 123/590 |
| 2003/0150439 | A1 | 8/2003 | Hsu | |
| 2004/0031471 | A1 * | 2/2004 | Leuenberger | 123/590 |

* cited by examiner

*Primary Examiner*—Stephen K. Cronin
*Assistant Examiner*—Jason Benton

(57) ABSTRACT

An easily installed versatile trimmable fit-to-size vortex airflow generator for use in internal combustion engines to enhance fuel efficiency is provided. The multi-impeller vortex generator comprises a plurality of blades evenly spaced angularly on a central hub. The blades are a ready trimmed to size to fit within the air intake conduit of most, if not essentially all, known conventional internal combustion engines. The vortex generator is constructed, i.e., formed, of a non-rigid construction such as molded plastic that is readily inserted in engine air intake passages to enhance turbulence.

11 Claims, 6 Drawing Sheets

VERSATILE VORTEX AIR GENERATOR AND METHOD OF INSTALLATION

FIELD OF THE INVENTION

The invention relates to a novel air vortex generator comprising a multi-blade rotary impeller, which maximizes airflow and substantially improves fuel vaporization in the combustion chamber of internal combustion engines.

BACKGROUND OF THE INVENTION

Internal combustion engines normally rely on pressure differential to draw fuel/air mixture into the combustion chamber. In a conventional engine, the piston recedes in the cylinder bore, away from the fuel/air inlet port during the intake stroke, opening the inlet port. As the piston recedes, it creates a partial vacuum in the combustion chamber, causing a pressure differential to develop between the combustion chamber and the outside atmosphere thereby drawing air through the carburetor through the intake manifold, past the intake valve and into the combustion chamber. As the air passes through the carburetor, fuel is mixed with the air to create a misty fuel/air mixture that is drawn into the combustion chamber. The engine energy is provided by the ignition of this fuel/air mixture.

While prior attempts have been directed to the enhancement of air flow in internal combustion engines, such as that disclosed in U.S. Patent Publication US 2003/0150439A1, the disclosure of which is incorporated herein by reference, such have been relatively complex or inefficient.

An important factor in the fuel efficiency of an engine is the degree to which the fuel released is mixed with air, and vaporized for ignition in the combustion chamber. Efficiency suffers if the turbulence of air, which affects fuel vaporization, is relatively quiescent. It is apparent that fuel that is not vaporized, i.e., fuel that remains in the liquid state as a droplet or mist will not ignite efficiently and consequently will not yield the maximum potential energy as does fully vaporized liquid fuel. It is desirable, therefore, that means to produce the maximum potential airflow turbulence for blending airflow with a predetermined quantity of liquid fuel, will substantially influence the degree of vaporization of the fuel.

An object of the present invention is to increase the turbulence of airflow used in the vaporization of fuel in an internal combustion engine.

It is a further object of the invention to provide a versatile readily fit-to-size vortex airflow generator for use with internal combustion engines to maximize airflow turbulence for liquid fuel vaporization.

Another, and more particular, object of the invention is to provide a multi-impeller blade rotor comprising blades that are readily trimmed to fit conventional size engine air inlets, permitting a snug fit that assures delivery of maximum airflow. A further object of the invention relates to the retrofitting method for installing the multi-impeller blade rotor. These and other objects of the invention will become apparent from the following description taken in conjunction with the accompanying drawings, which set forth the preferred embodiment of the invention.

DETAILED DESCRIPTION OF THE INVENTION

In connection with the description which follows and which is directed to a preferred embodiment, it is contemplated that in addition to the details of the invention described, modifications, equivalents and alternatives to such details are within the scope of the invention.

Figure 1:
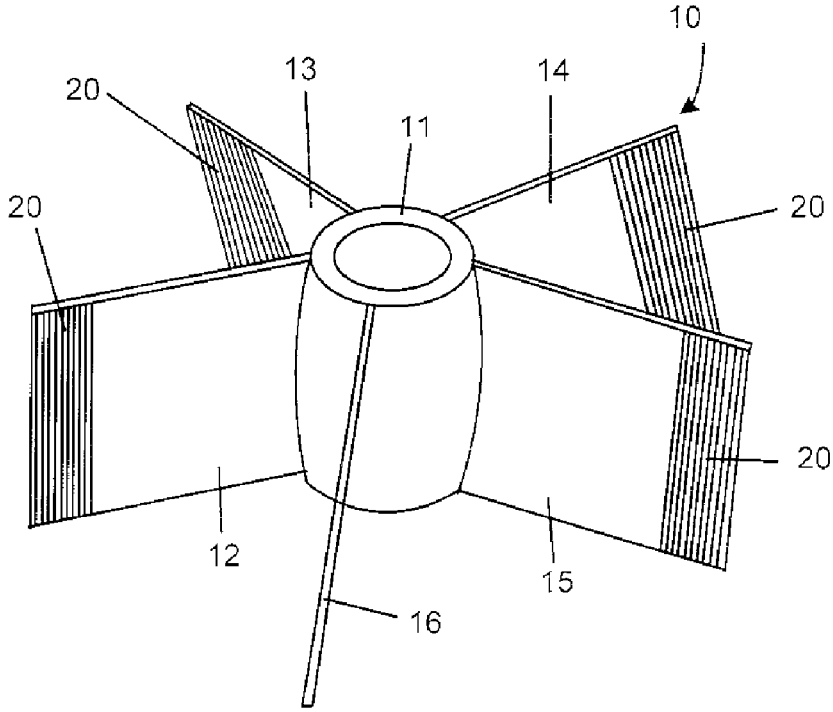
FIG. 1 is a perspective view of the multi-blade airflow maximizing vortex generator of the invention containing a plurality of size-trimming indentations in the blades.
Figure 2:
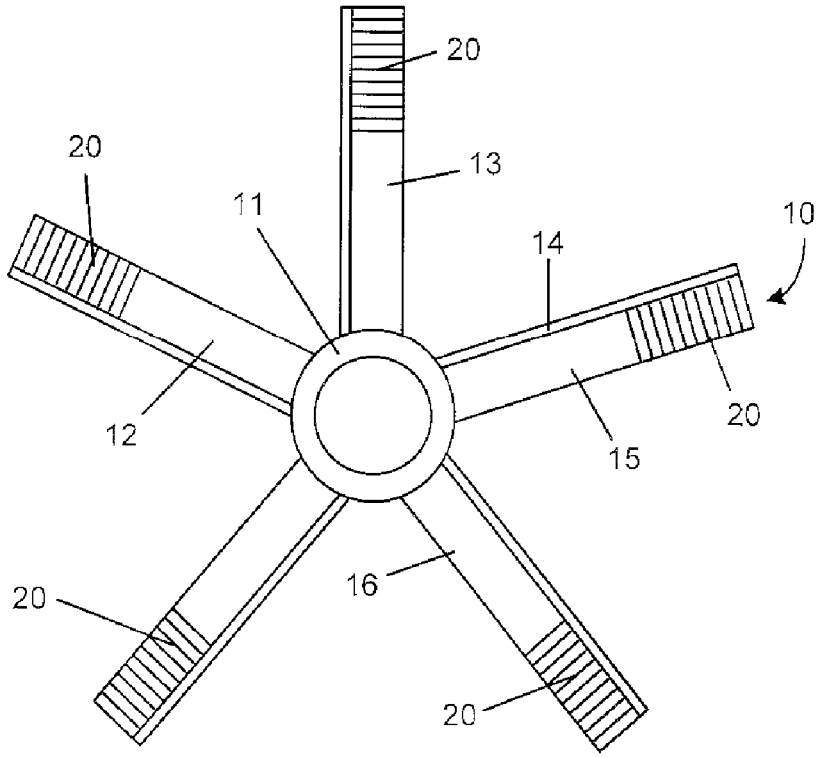
FIG. 2 is a plan view of the vortex generator.
Figure 3:
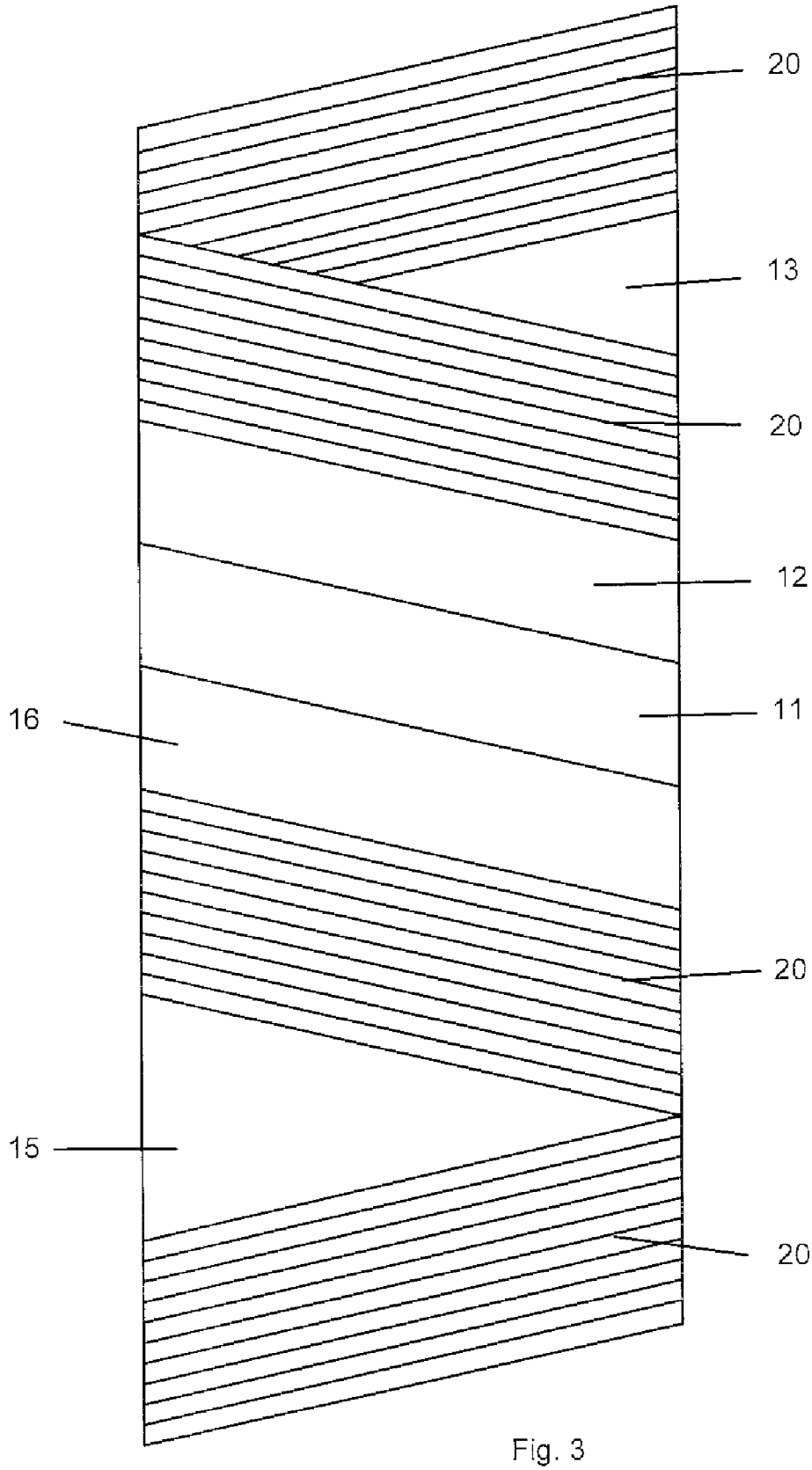
FIG. 3 is an end view of the vortex generator.

Referring in particular to FIGS. 1, 2 and 3 of the drawing, the versatile vortex generator impeller rotor 10 comprising a plurality of blades referenced 12-16 angularly mounted on a cylindrical hub 11 is illustrated. While the number of blades may vary, five (5) blades is preferred from the standpoint of mounting facility, stability, durability and maximum volume and vortex air movement.

An essential feature of the invention resides in the versatility of the vortex generator in that the unit can be readily sized, i.e., trimmed to fit, within the air intake conduits of almost all fuel injected vehicles by simply cutting off the appropriate amount from the tips of the impeller blades such that the vortex generator fits snugly in the air intake opening of the engine as illustrated and described in more detail hereinafter by reference to FIG. 4 of the drawing.

The vortex generator is constructed preferably of a high impact semi-rigid composition preferably a plastic composition having these properties. High impact molded nylon is most preferable.

As seen by reference to FIGS. 1 through 3 of the drawing, the blades are configured in length so as to comprise a plurality of size delineations 20, which serve to enable the blades to be trimmed to the desired appropriate length to fit the diameter of engine air intake openings. The delineation or severing indentation 20 on the blades extend along the length and may optionally carry measurement markings (not shown) which may aid in increasing each of the blades to the same measurement mark length.

The hub 11 of the vortex generator is constructed so as to possess a sufficient thickness to afford substantial strength and rigidity relative to the blade dimensions for which a moderate level of flexibility is desirable.

Figure 4A:
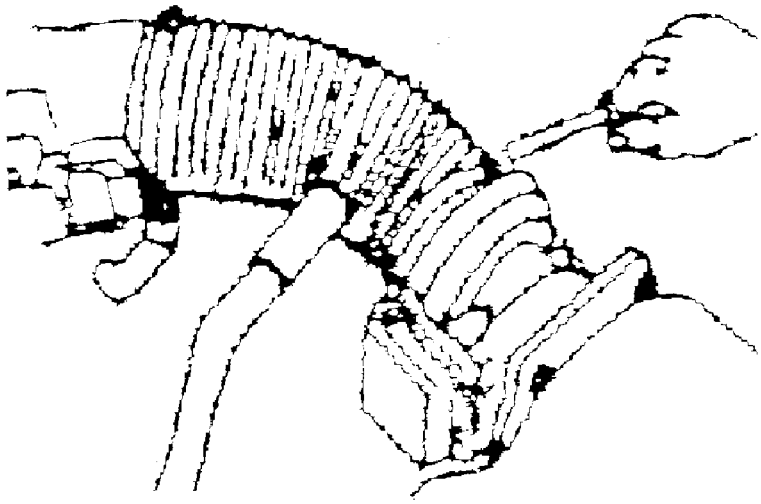
FIG. 4 illustrates a sequence of steps for retrofitting the rotor of the invention in the air intake conduits of an internal combustion engine.
Figure 4B:
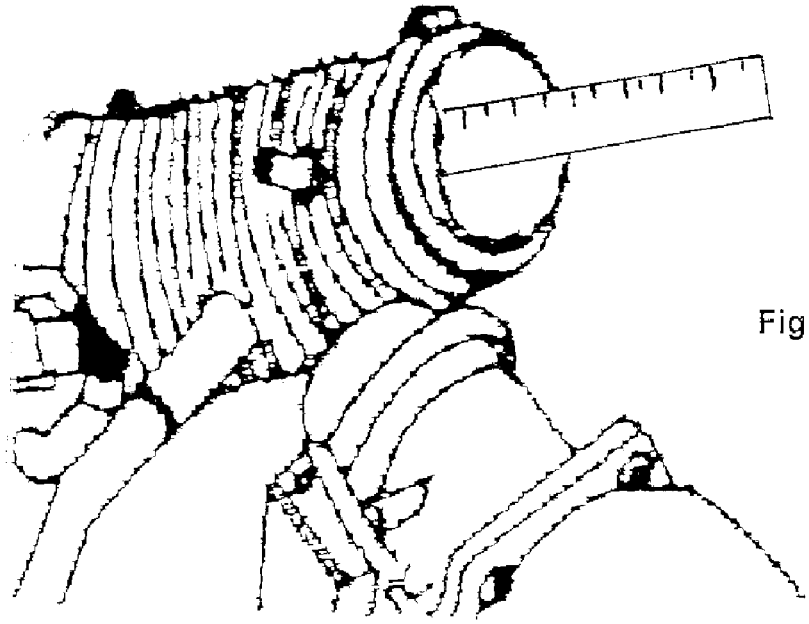
Figure 4C:
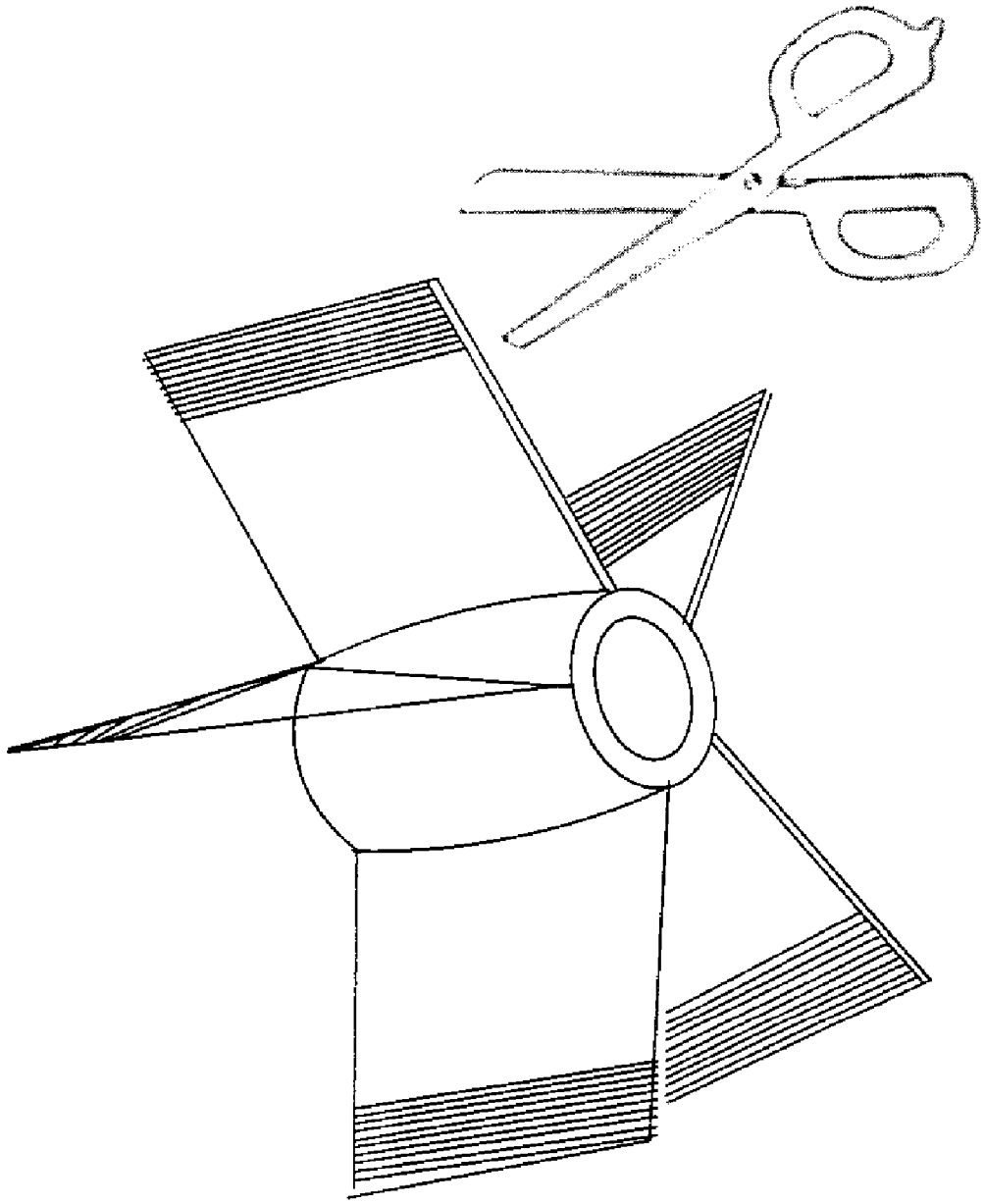
Figure 4D:
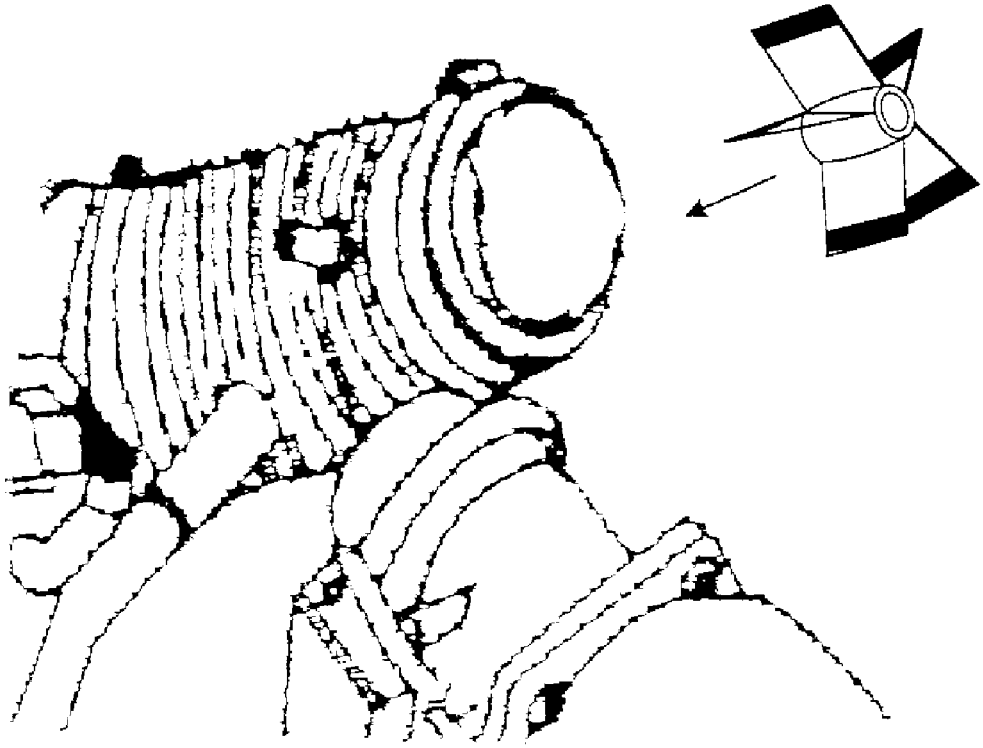
Figure 4E:
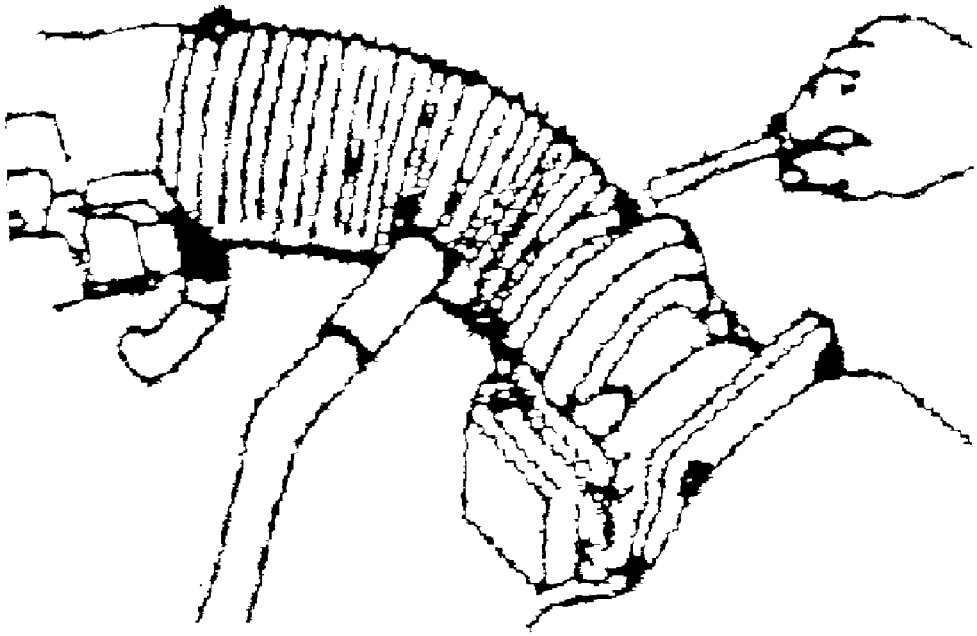

The sizing to fit the desired air intake opening and easy installation of the vortex generator is illustrated and described by reference to FIGS. 4*a*-4*e* of the drawing. As seen in FIG. 4*a* the first step is to disconnect the air intake conduit into the opening of which the vortex generator is to be inserted. In the next sequence illustrated in FIG. 4*b*, the diameter of the opening is measured so as to trim, i.e., cut off, the ends of the blades 12 through 16 equally to the proper lengths. It is preferred that the portion cut off from the blade extremity not exceed that which will afford a snug fit, such that the blades will snugly contact the inner periphery of the air intake conduit. Since the selection of a suitable plastic material such as nylon infrequently affords flexibility, a firm pressure on the blade extremities with the inner periphery of the air inlet conduit assures full air volume delivery with minimal, if any, air back leakage, as illustrated in FIGS. 4*c*, 4*d* and 4*e*.

The blade extremities are trimmed to the appropriate lengths, the vortex generator is inserted into the air intake conduit and the conduit, with vortex generator in place, is reconnected respectively.

It is thus seen that the vortex generator is designed to be custom fitted to each vehicle in which it is installed. The generator is trimmed to fit by removing blade tips (usually with scissors or a knife) and easily inserted in the air conduit intake by compressing the plastic blade ends gently into the opening for a tight fit. In the process of installing, the air inlet conduit is disconnected by loosening a screw or clamp (this conduit is connected to the air filter box). Then, after measuring the inside diameter the air intake conduit, cut off the appropriate number of tabs to provide a snug fit, compress the plastic gently and push the vortex generating device in to the air intake conduit. Only the minimum number of tabs should be removed such that the resistance of the plastic blades against the air intake conduit provides the necessary force to keep the device in place. Reconnect the air intake conduit and the installation is complete. The vortex generating device of the invention is stationary—no moving parts and since it is formed from durable semi-rigid plastic it is not subject to deformation and/or breakage—so it poses no threat to damage the engine.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. a trimmable to size, bidirectional vortex generator for insertion in an air intake conduit for increasing air intake turbulence and enhancing fuel combustion efficiency in internal combustion engines comprising:

(a) a central cylindrical hub;

(b) a plurality of trimmable-to-fit angularly displaced equally spaced and extending from said hub;

(c) said blades having a plurality of horizontal integrally formed demarcation extending the length of the blades;

(d) said blades being trimmable equally to the appropriate blade length to fit the desired air intake conduit; and (e) said blades arranged in such manner as to produce equal turbulence in downstream airflow without regard to forward or reverse orientation.

2. The vortex generator of claim 1 that is molded from a semi-rigid plastic composition.

3. The vortex generator of claim 2 formed from a nylon composition.

4. The vortex generator of claim 2 in which the integrally formed demarcation on the blades contains measurement indicators to and in cutting off same portion from the tips of each blade.

5. The vortex generator of claim 1 wherein each of the blades is angularly displaced on the hub at an angle of approximately 45 degrees.

6. The vortex generator of claim 1 comprising five (5) blades angularly displaced on said hub at an angle of approximately 45 degrees.

7. The vortex generator of claim 3 comprising five (5) blades angularly displaced on said hub at an angle of approximately 45 degrees.

8. A method of retrofitting a trimmable-to-fit air vortex generating element in the air intake conduit of an internal combustion engine comprising:

(a) providing a vortex generator having blades with several horizontal demarcations extending at least along the extremity of each blade on a central hub;

(b) disconnecting the air intake conduit, measuring the inner diameter of the air intake conduit;

(c) trimming off the same portion from the extremity of each blade such that the trimmed vortex is snugly insertable in said air intake conduit;

(d) inserting said vortex generator in the air intake conduit; and (e) reconnecting the air intake conduit.

9. The method of claim 8 wherein the vortex generator comprises five (5) blades that are mounted angularly on said hub at about an angle of 45 degrees.

10. The method of claim 8 wherein the vortex generator is molded from a synthetic resinous composition.

11. The method of claim 10 wherever the resinous composition is nylon.

* * * * *